US008052023B2

(12) United States Patent
Co

(10) Patent No.: US 8,052,023 B2
(45) Date of Patent: Nov. 8, 2011

(54) LIGHT WEIGHT HAND-OPERATED STAPLER

(75) Inventor: Victor Co, Kowloon (HK)

(73) Assignee: Cosimex (H.K.) Limited, Kowloon (HK)

( * ) Notice: Subject to any disclaimer, the term of this patent is extended or adjusted under 35 U.S.C. 154(b) by 289 days.

(21) Appl. No.: 12/551,582

(22) Filed: Sep. 1, 2009

(65) Prior Publication Data

US 2011/0049214 A1 Mar. 3, 2011

(51) Int. Cl.
*B25C 5/06* (2006.01)

(52) U.S. Cl. ..... 227/134; 227/120

(58) Field of Classification Search ..... 227/120, 227/134, 132, 156, 128
See application file for complete search history.

(56) References Cited

U.S. PATENT DOCUMENTS 6,062,457 A * 5/2000 Huang ..... 227/134
6,152,347 A * 11/2000 Wilson et al. ..... 227/134
6,286,745 B1 * 9/2001 Ackeret ..... 227/76
6,494,356 B1 * 12/2002 Frank et al. ..... 227/127
6,550,661 B2 * 4/2003 Aoki ..... 227/134
7,014,090 B1 * 3/2006 Chang ..... 227/132
7,387,227 B1 * 6/2008 Jiang et al. ..... 227/8
7,431,186 B2 * 10/2008 Hsu ..... 227/120
7,513,406 B2 * 4/2009 Marks ..... 227/120
7,661,569 B2 * 2/2010 Matsukawa ..... 227/129
7,665,643 B2 * 2/2010 Huang ..... 227/128

* cited by examiner

*Primary Examiner* — Scott A. Smith

(57) ABSTRACT

A light weight hand-operated stapler which comprises a pressing cap, a plastic head, a metal drive plate, a base and a plastic magazine which is connected to the base via a hanger and connected to the plastic head via a pin, a metal guide head disposed at a front end of the plastic magazine and substantially covering the front wall of the plastic magazine, a first elastic mechanism for pushing the staples down the plastic magazine to reload the stapler, a second elastic member disposed between the pressing cap and the plastic head for pushing the pressing cap up to its original position after stapling, and a third elastic member disposed between the base and the plastic magazine for pushing the plastic magazine up to its original position after stapling.

7 Claims, 3 Drawing Sheets

LIGHT WEIGHT HAND-OPERATED STAPLER

BACKGROUND OF THE INVENTION

The present invention relates to a hand-operated stapler for stapling sheets of paper and more particularly pertains to a light weight hand-operated stapler.

A conventional hand-operated stapler comprises a metal head covered by a metal pressing cap, a metal base with a metal anvil at the stapling end, and a metal magazine for holding staples which is connected to the base via a metal hanger and connected to the metal head via a pin. A conventional stapler also comprises a first spring for pushing the staples down the magazine to reload the stapler, a second spring disposed between the pressing cap and the metal head for pushing the pressing cap up to its original position after stapling, and a third spring disposed between the base and the magazine for pushing the magazine up to its original position after stapling. When the user uses the stapler, the user presses the pressing cap downward, thereby driving a metal drive plate disposed at a front end of the metal head to move downward and push the front staple down the magazine. The front staple then pierces the papers and come into contact with the anvil, and the legs of the staple are then bended inwards.

As the drive plate comes into contact with the magazine every time when the user staples, the magazine is subject to wear and tear by the driver plate. The magazine is therefore usually made of metal so as to enhance durability. However, staplers with metal magazine are susceptible to higher manufacturing costs. Besides, they are heavier in weight and users easily get tired after repeated use of such staplers over a short period of time. Users are therefore looking forward to hand-operated staplers which are light in weight.

BRIEF SUMMARY OF THE INVENTION

In view of the aforesaid disadvantages now present in the prior art, the object of the present invention is to provide a hand-operated stapler that is light in weight and susceptible to lower manufacturing costs.

To attain this, the present invention generally comprises a pressing cap; a plastic head covered by the pressing cap; a metal drive plate disposed at a front end of the plastic head; a base with an anvil at a front end thereof; a plastic magazine for holding staples which is connected to the base via a hanger and connected to the plastic head via a pin, and the magazine is in form of an open box comprising a front wall, a left wall, a right wall and a bottom; a metal guide head disposed inside the magazine at a front end thereof and substantially covering the front wall and front portions of the left wall, the right wall and the bottom of the plastic magazine; a first elastic mechanism for pushing the staples down the plastic magazine to reload the stapler; a second elastic member disposed between the pressing cap and the plastic head for pushing the pressing cap up to its original position after stapling; and a third elastic member disposed between the base and the plastic magazine for pushing the plastic magazine up to its original position after stapling.

A recess is provided at the front end of the plastic magazine for receiving the metal guide head.

The first elastic mechanism comprises a metal coil spring and a plastic staple actuating member; wherein a first end of the coil spring is attached to a rear end of the staple actuating member and a second end of the coil spring is attached to a hook disposed at a front portion of the plastic head, and the staple actuating member moves forward and rearward along the magazine.

The left wall and the right wall of the plastic magazine is each provided with a guide rail, and the staple actuating member is provided with protruding members on its left side and right side for engaging with the guide rails respectively.

The second elastic member is in form of a plastic sheet bent to form a shape resembling letter "S", wherein an upper portion of the second elastic member is affixed to the pressing cap and a lower portion of the second elastic member is slidably engaged with the plastic head. As the pressing cap is pushed downward, the lower portion of the second elastic member is forced to move towards a rear end of the plastic head; and when the pressing cap is no longer being pushed downward, pressure forcing the lower portion of the second elastic member to move rearward is released and the lower portion of the second elastic member then returns to its original position.

The third elastic member is in form of a plastic sheet bent to form a shape resembling letter "S", wherein a lower portion of the third elastic member is affixed to the base and an upper portion of the third elastic member is slidably engaged with the magazine. As the magazine is pushed downward, the upper portion of the third elastic member is forced to move forward; and when the magazine is no longer being pushed downward, pressure forcing the upper portion of the third elastic member to move forward is released and the upper portion of the third elastic member then returns to its original position.

The pressing cap, the hanger, the pin and the base are made of plastic material.

In comparison with the prior art, all components of the present invention except for the metal guide head, the drive plate, the anvil and the metal coil spring are made of plastic. As a result, the overall weight as well as the manufacturing costs of the stapler of the present invention are reduced significantly. The use of the metal guide head also improves the durability of the stapler.

DETAILED DESCRIPTION OF THE INVENTION

Figure 1:
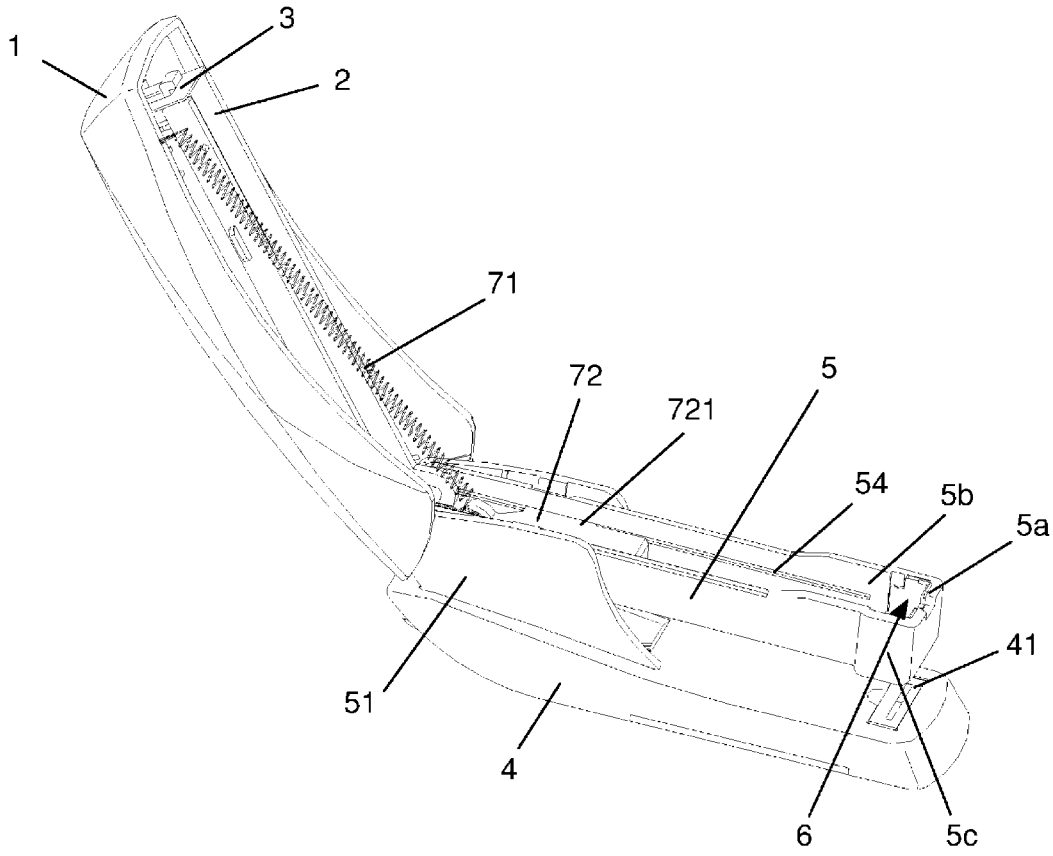
FIG. 1 shows a perspective view of the present invention when the pressing cap is opened.
Figure 2:
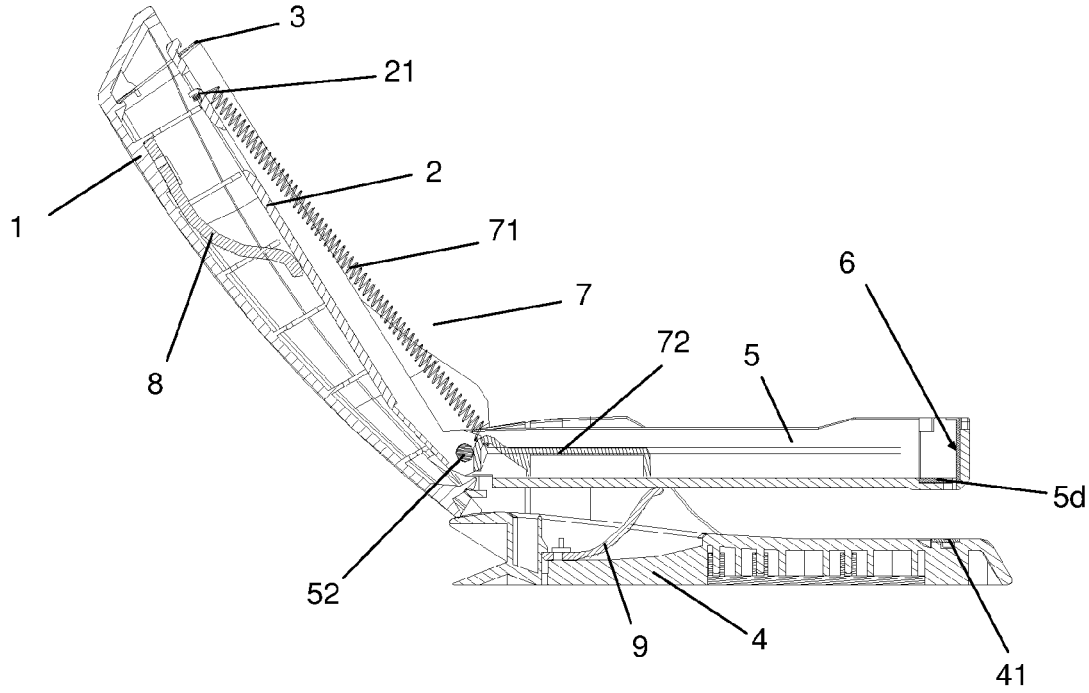
FIG. 2 is a cross-sectional view of the present invention when the pressing cap is opened.
Figure 3:
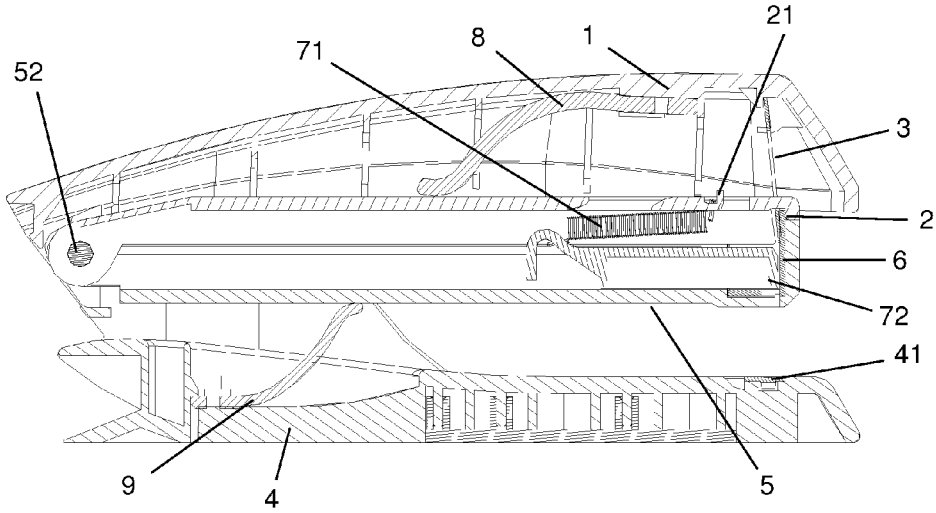
FIG. 3 is a cross-section view of the present invention when the present invention is not in use.
Figure 4:
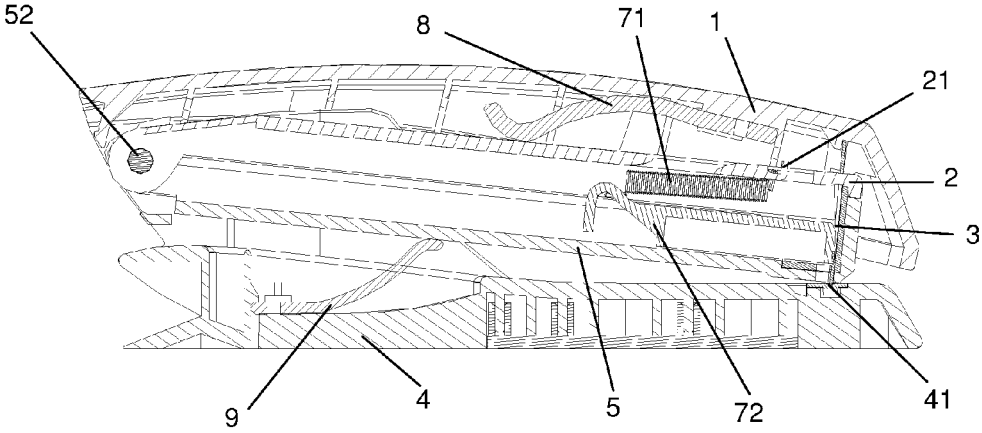
FIG. 4 is a cross-sectional view of the present invention while stapling.

As illustrated in FIGS. 1 to 4, the present invention generally comprises a pressing cap 1, a plastic head 2, a metal drive plate 3, a base 4, a plastic magazine 5, a metal guide head 6, a first elastic mechanism 7, a second elastic mechanism 8 and a third elastic mechanism 9. The plastic head 2 is covered by the pressing cap 21. The metal drive plate 3 is disposed at a front end of the plastic head 2. The base 4 has an anvil 41 at a front end thereof. The plastic magazine 5 which is for holding staples is connected to the base 4 via a hanger 51 and connected to the plastic head 2 via a pin 52. The magazine 5 is in form of an open box comprising a front wall 5*a*, a left wall 5*b*, a right wall 5*c* and a bottom 5*d*. The metal guide head 6 is disposed inside the magazine 5 at a front end thereof and substantially covering the front wall 5*a* and front portions of the left wall 5*b*, the right wall 5*c* and the bottom 5*d* of the plastic magazine 5. The first elastic mechanism 7 is for pushing the staples down the plastic magazine 5 to reload the staple. The second elastic member 8 is disposed between the pressing cap 1 and the plastic head 2 for pushing the pressing cap 1 up to its original position after stapling. The third elastic member 9 is disposed between the base 4 and the plastic magazine 5 for pushing the plastic magazine 5 up to its original position after stapling. A recess 53 is provided at the front end of the plastic magazine 5 for receiving the metal guide head 6. The pressing cap 1, the hanger 51, the pin 52 and the base 4 are made of plastic material.

The first elastic mechanism 7 comprises a metal coil spring 71 and a plastic staple actuating member 72. A first end of the coil spring 71 is attached to a rear end of the staple actuating member 72 and a second end of the coil spring 71 is attached to a hook 21 disposed at a front portion of the plastic head 2, and the staple actuating member 72 moves forward and rearward along the magazine 5. The left wall and the right wall of the plastic magazine 5 is each provided with a guide rail 54, and the staple actuating member 72 is provided with protruding members 721 on its left side and right side for engaging with the guide rails 54 respectively.

The second elastic member 8 is in form of a plastic sheet bent to form a shape resembling letter "S". An upper portion of the second elastic member 8 is affixed to the pressing cap 1 and a lower portion of the second elastic member 8 is slidably engaged with the plastic head 2. As the pressing cap 1 is pushed downward, the lower portion of the second elastic member 8 is forced to move towards a rear end of the plastic head 2. When the pressing cap 1 is no longer being pushed downward, pressure forcing the lower portion of the second elastic member 8 to move rearward is released and the lower portion of the second elastic member 8 then returns to its original position.

The third elastic member 9 is in form of a plastic sheet bent to form a shape resembling letter "S". A lower portion of the third elastic member 9 is affixed to the base 4 and an upper portion of the third elastic member 9 is slidably engaged with the magazine 5. As the magazine 5 is pushed downward, the upper portion of the third elastic member 9 is forced to move forward. When the magazine 5 is no longer being pushed downward, pressure forcing the upper portion of the third elastic member 9 to move forward is released and the upper portion of the third elastic member 9 then returns to its original position.

What is claimed is:

1. A light weight hand-operated stapler which comprises a pressing cap;

a plastic head covered by the pressing cap;

a metal drive plate disposed at a front end of the plastic head;

a base with an anvil at a front end thereof;

a plastic magazine for holding staples which is connected to the base via a hanger and connected to the plastic head via a pin, and the magazine is in the form of an open box comprising a front wall, a left wall, a right wall and a bottom;

a metal guide head disposed inside the plastic magazine at a front end thereof and substantially covering the front wall and front portions of the left wall, the right wall and the bottom of the plastic magazine;

a first elastic mechanism for pushing the staples down the plastic magazine to reload the stapler;

a second elastic member disposed between the pressing cap and the plastic head for pushing the pressing cap up to its original position after stapling; and a third elastic member disposed between the base and the plastic magazine for pushing the plastic magazine up to its original position after stapling.

2. The light weight hand-operated stapler as in claim 1, wherein a recess is provided at the front end of the plastic magazine for receiving the metal guide head.

3. The light weight hand-operated stapler as in claim 1, wherein the first elastic mechanism comprises a metal coil spring and a plastic staple actuating member; wherein a first end of the coil spring is attached to a rear end of the staple actuating member and a second end of the coil spring is attached to a hook disposed at a front portion of the plastic head, and the staple actuating member moves forward and rearward along the magazine.

4. The light weight hand-operated stapler as in claim 3, wherein the left wall and the right wall of the plastic magazine is each provided with a guide rail, and the staple actuating member is provided with protruding members on its left side and right side for engaging with the guide rails respectively.

5. The light weight hand-operated stapler as in claim 1, wherein the second elastic member is in form of a plastic sheet bent to form a shape resembling letter "S", wherein an upper portion of the second elastic member is affixed to the pressing cap and a lower portion of the second elastic member is slidably engaged with the plastic head.

6. The light weight hand-operated stapler as in claim 1, wherein the third elastic member is in form of a plastic sheet bent to form a shape resembling letter "S", wherein a lower portion of the third elastic member is affixed to the base and an upper portion of the third elastic member is slidably engaged with the magazine.

7. The light weight hand-operated stapler as in claim 1, wherein the pressing cap, the hanger, the pin and the base are made of plastic material.

* * * * *